US009616563B2

(12) United States Patent
Vilkormirski et al.

(10) Patent No.: US 9,616,563 B2
(45) Date of Patent: Apr. 11, 2017

(54) TOOL ORGANIZER

(71) Applicant: The Stanley Works Israel, Ltd, Rosh Ha'Ayin (IL)

(72) Inventors: Gil Vilkormirski, Ein Vered (IL); Nadin Daniel Horovitz, Rehovot (IL); Elad Hay Shitrit, Tel Aviv (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 0 days.

(21) Appl. No.: 14/306,340

(22) Filed: Jun. 17, 2014

(65) Prior Publication Data

US 2014/0374297 A1 Dec. 25, 2014

(30) Foreign Application Priority Data

Jun. 20, 2013 (EP) ..... 13172986

(51) Int. Cl.
*B65D 85/28* (2006.01)
*B25H 3/02* (2006.01)

(52) U.S. Cl.
CPC ..... *B25H 3/025* (2013.01); *B25H 3/023* (2013.01)

(58) Field of Classification Search
CPC ..... B25H 3/023; B25H 3/025; B65D 45/20; B65D 45/22; B65D 2251/158
USPC ..... 206/373; 220/253, 528, 811–813, 826, 220/285, 320, 324, 326, 835, 833, 788, 220/786; 312/902
See application file for complete search history.

(56) References Cited

U.S. PATENT DOCUMENTS 131,748 A * 10/1872 Fowler ..... B65F 1/16 220/378
622,441 A * 4/1899 Brooks ..... B65F 1/16 220/813
1,199,596 A * 9/1916 Noll ..... B65D 43/162 220/315
1,314,065 A * 8/1919 Jackson ..... B65D 47/242 220/813

(Continued)

FOREIGN PATENT DOCUMENTS

DE 102007042972 A1 6/2008
DE 102009019713 * 11/2010 ..... B25H 3/023

(Continued)

OTHER PUBLICATIONS

Lehmann, Ernst von; Patent Translate, Description DE102009019713 (Machine Translation of Foreign Document); Feb. 16, 2016; p. 1-27.*

(Continued)

*Primary Examiner* — Justin Larson
*Assistant Examiner* — Jennifer N Zettl
(74) *Attorney, Agent, or Firm* — Gabriel A. Haboubi

(57) ABSTRACT

A toolbox has a central section and at least one side section. The side sections are pivotally attached to the central section using a pin and slot arrangement which allows an eccentric path to be followed as the side sections pivot around the central section. This allows freedom of design of the dimensions of a central tray in the central section without obstructing pivoting of the side sections. A latch may be provided which slightly opens the side sections when it is in its unlatched position allowing a user to see that the sides are not properly latched.

11 Claims, 8 Drawing Sheets

(56) References Cited

U.S. PATENT DOCUMENTS 1,328,672 A * 1/1920 Hirsohn ..... B65D 25/32 220/212.5
1,462,245 A * 7/1923 Reglein ..... B25H 3/023 190/110
1,472,707 A * 10/1923 Weisz ..... B65F 1/1623 16/444
1,586,319 A * 5/1926 Meyerson ..... B25H 3/023 312/266
1,597,092 A * 8/1926 McTighe ..... B25H 3/02 206/373
1,653,293 A * 12/1927 Kendall ..... A45D 33/006 132/301
1,684,036 A * 9/1928 Kennedy ..... B25H 3/023 190/17
1,698,039 A * 1/1929 Wharam ..... F01P 11/0214 220/291
1,790,498 A * 1/1931 Dewey ..... B25H 3/02 131/242
1,845,202 A * 2/1932 Shriver ..... B25H 3/023 312/244
1,856,035 A * 4/1932 Weil ..... A45C 11/10 206/266
1,973,825 A * 9/1934 Pratt ..... B25H 3/023 312/269
1,997,043 A * 4/1935 Clark ..... A24F 15/18 131/242
2,044,661 A * 6/1936 Bentz ..... B25H 3/023 223/107
2,055,657 A * 9/1936 Gordon ..... 190/114
2,488,067 A 11/1949 Roark
2,541,890 A * 2/1951 Schaperkotter ..... A01K 97/06 16/374
2,558,124 A * 6/1951 Burden ..... 43/57.1
2,584,721 A * 2/1952 Linneman ..... B25H 3/003 16/307
2,695,210 A * 11/1954 Evans ..... B25H 3/006 190/11
2,697,460 A * 12/1954 Barnett ..... B23D 45/068 144/285
2,741,505 A * 4/1956 Courney ..... E05B 63/246 292/128
2,864,635 A * 12/1958 Lindner ..... E05B 83/24 292/12
2,880,918 A * 4/1959 Schweikhard ..... B25H 3/023 206/373
2,929,648 A * 3/1960 Mitchell ..... E05C 19/022 292/198
2,936,066 A * 5/1960 Meksula ..... 312/324
3,113,817 A * 12/1963 Imel ..... 312/199
3,259,230 A * 7/1966 Jaeger ..... B25H 3/023 206/373
3,310,905 A * 3/1967 Davis et al. ..... 43/57.1
3,514,142 A * 5/1970 Smith ..... E05B 13/002 292/108
3,713,529 A * 1/1973 Meksula ..... B25H 3/023 190/11
3,784,046 A * 1/1974 Cata ..... A45C 11/24 206/261
4,238,049 A * 12/1980 Lehmann ..... B65D 45/16 220/812
4,561,705 A * 12/1985 Schafer ..... 312/244
4,643,494 A * 2/1987 Marleau ..... 312/111
4,998,616 A * 3/1991 Hillinger ..... 206/748
5,054,669 A * 10/1991 Zimbardi et al. ..... 224/406
5,205,431 A * 4/1993 Zinnbauer ..... A45D 40/22 132/293
6,062,385 A * 5/2000 Cho ..... 206/373
7,325,682 B2 * 2/2008 Seymour ..... B25H 3/003 206/379
7,686,364 B2 * 3/2010 Hehn ..... B60R 7/04 220/812
8,210,387 B2 * 7/2012 Twig et al. ..... 220/521
2006/0006185 A1 * 1/2006 Katagiri ..... B60N 3/101 220/740
2006/0054630 A1 * 3/2006 Katagiri ..... B60R 7/06 220/830
2007/0205208 A1 * 9/2007 Ueda ..... G03B 17/02 220/813
2009/0223971 A1 * 9/2009 Moffett ..... 220/500
2010/0033325 A1 * 2/2010 Vilkomirski et al. ..... 340/540
2013/0270286 A1 * 10/2013 Fukui ..... B60R 7/04 220/811

FOREIGN PATENT DOCUMENTS

DE 102011086800 A1 5/2013
EP 0554185 A1 8/1993
EP 2436492 A2 4/2012
GB 764061 A 12/1956
GB 2441760 A 3/2008

OTHER PUBLICATIONS

David Radu, European Search Report, Nov. 22, 2013, The Hague, Netherlands.
Annex to the European Search Report on European Patent Application No. EP 13 17 2986.

* cited by examiner

TOOL ORGANIZER

CROSS-REFERENCE TO RELATED APPLICATIONS

This application claims priority, under 35 U.S.C. §119, to European Patent Application No. 13172986.5, filed Jun. 20, 2013, titled "TOOL ORGANISER".

FIELD OF THE INVENTION

This invention relates to a toolbox or tool organiser for storing items such as hand tools, power tools, tool accessories and screws or the like.

BACKGROUND OF THE INVENTION

Toolboxes with handles to allow carrying and fold out compartments are well known. For example U.S. Pat. No. 2,936,066 describes a fishing tackle box having a central section with a carrying handle and fold out side trays which are hinged to the central section and have trays with transverse and longitudinal partitions for the reception of items such as bait and small fishing tackle. The side trays may be kept latched in a vertical position using traditional over centre catches.

Another example of a prior art toolbox is disclosed in U.S. Pat. No. 6,648,166. This describes a more modern interpretation of the fishing tackle box of U.S. Pat. No. 2,936,066 and also has a central section with a handle and fold-out side trays which may be latched in the vertical position. This disclosure however allows the side trays to rest flat on the same surface as the central section which provides for greater stability in the open position and also allows heavier items to be stored in the side sections. However, to achieve this improved stability design, the central section has had to be made small and only contains small storage compartments.

With increasing availability of bulky items such as battery powered hand power tools, it increasingly desirable to be able to store larger items in a toolbox of the type described above. However, in U.S. Pat. No. 6,648,166, there are no compartments suitable for storing power tools and in U.S. Pat. No. 2,936,066 the central compartment contains very little storage and the side trays are both too small and too unstable (even requiring a support leg to avoid toppling) to store large and heavy items such as power tools.

BRIEF SUMMARY OF THE INVENTION

Accordingly, in a first aspect, there is provided a toolbox as claimed in Claim 1 appended hereto.

By designing the sections to be able to pivot in an eccentric path, it is possible to provide large storage compartments in a central section and yet still allow a side section to fold out and lie on the same surface as the base of the central section. Thus, for example, it is possible to provide power tool compartments in a central section of the toolbox and still have considerable flexibility in storage options for the fold out sections. This is not possible in the prior art design of U.S. Pat. No. 6,648,166, for example, because a large storage compartment would prevent the side sections folding out onto the same surface as the central section and would necessitate a design similar to that of U.S. Pat. No. 2,936,066.

Preferably, one of the sections includes a cam-surface and the other section includes a cam follower surface with biasing means, biasing the cam and cam follower together through at least part of the eccentric path. In this way the eccentric path may be controlled and also any looseness of the hinge may be avoided. A further advantage of this arrangement is that by causing the biasing means to operate more weakly at the extremities of the eccentric path, the pivoting action is caused to have a locking sensation at the open and closed positions as a user pivot the sections between the two positions.

Preferably, the toolbox has a latch operable to secure the sections together which includes a lever arranged to push the two sections apart when the latch is pivoted to an open position. In this way a user may readily see whether the toolbox is securely latched closed or is in a partially open position. This is important because in the prior art some tool boxes do not provide this indication and if the toolbox is lifted with unlatched side sections, these sections may flop open causing toolbox contents to fall out of the toolbox.

In a second aspect, the invention provides a toolbox as claimed in Claim 11 appended hereto.

BRIEF DESCRIPTION OF THE DRAWINGS

An embodiment of the invention will now be described by way of example with reference to the drawings in which.

DETAILED DESCRIPTION OF THE INVENTION

Figure 1:
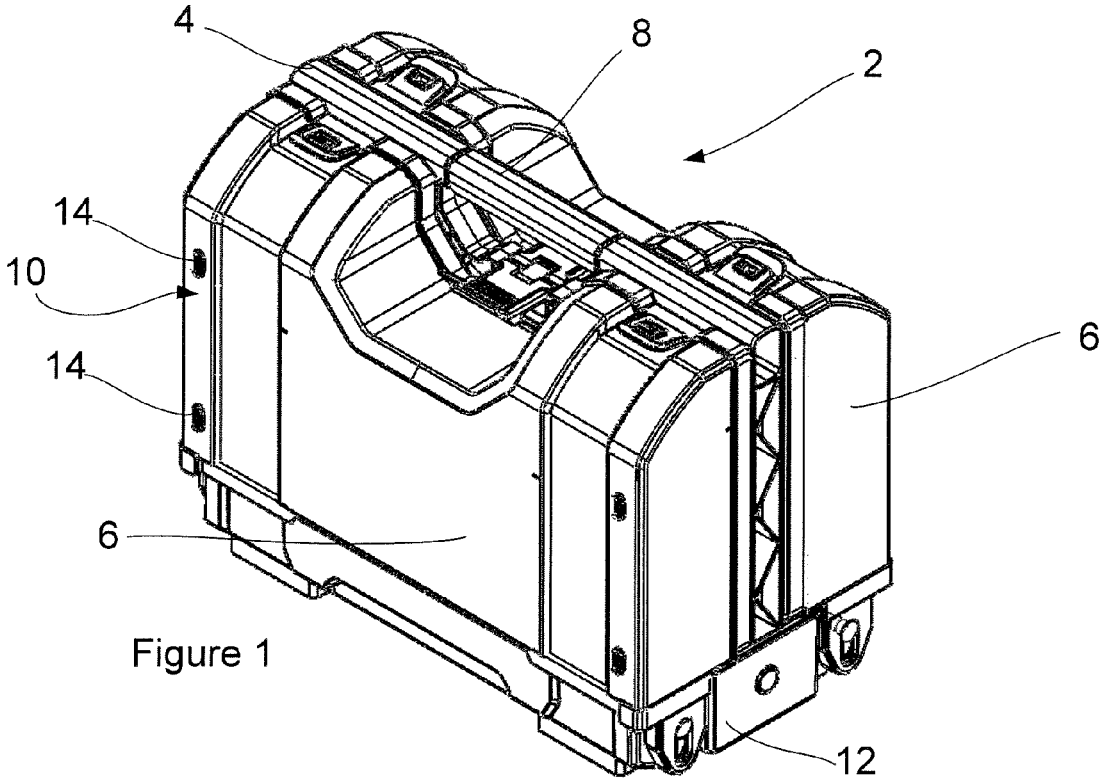
FIG. 1 is a perspective view of a closed toolbox.
Figure 2:
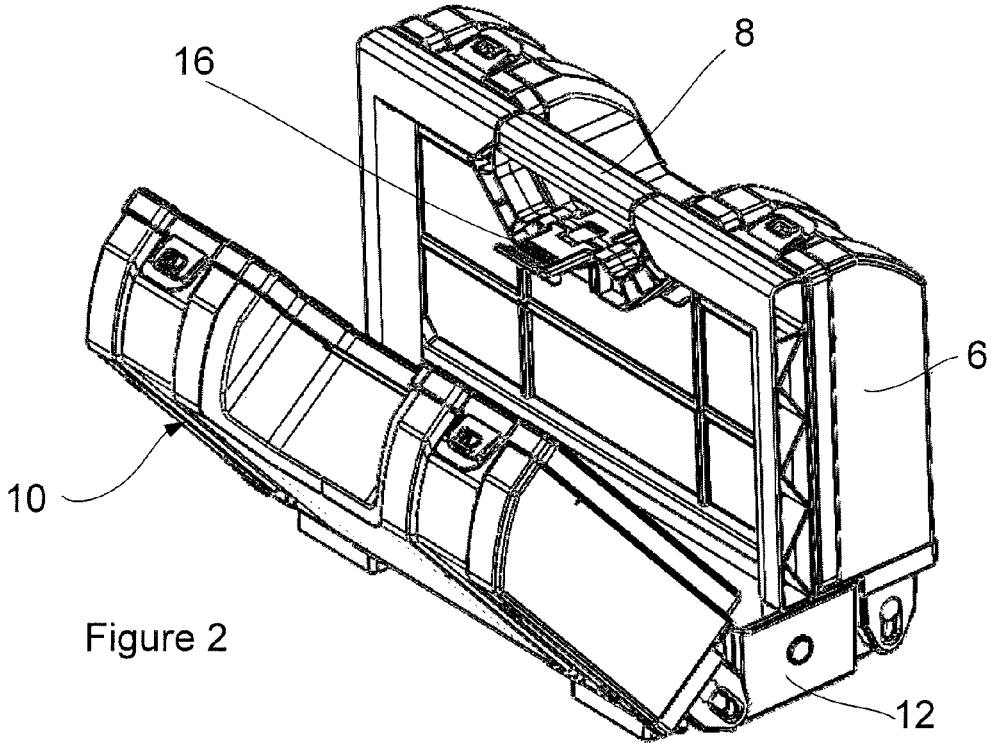
FIG. 2 is a perspective view showing one side section partially open.

With reference to FIGS. 1 to 4, a toolbox 2 has a central section 4 and two side sections 6. In an embodiment the central section 4 may be referred to as a first section, and each side section 6 may be referred to as a second section.

The central section 4 has a carrying handle 8 and the side sections 6 are arranged to pivot about the central section to fold down through approximately 90° to come to rest with their outer surfaces 10 resting on the same surface as the base 12 of the central section 4.

The toolbox 2 is further provided with feet 14 on the outer surfaces 10 and also with a latching mechanism (described in more detail below) 16 which allows each of the side sections 6 to be independently disengaged and folded outwardly into the positions shown in FIGS. 3 and 4.

The toolbox may be provided with one or more side sections on only one side and there may be a plurality of side sections on each side.

Figure 3:
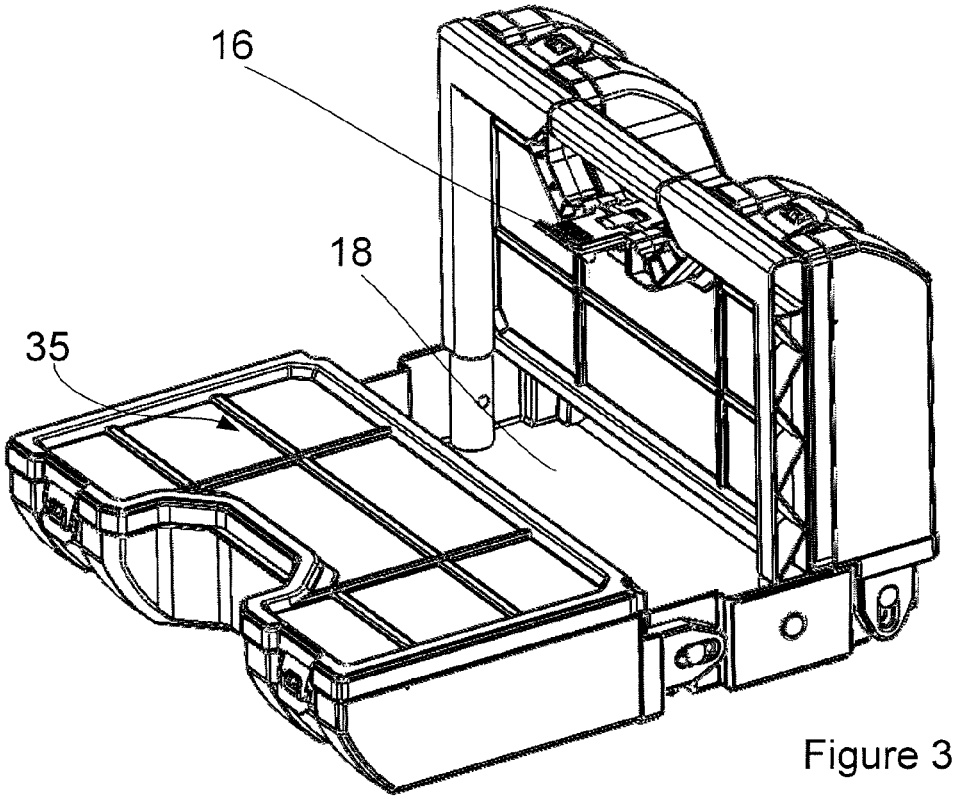
FIG. 3 is a perspective view showing one side section fully open.
Figure 4:
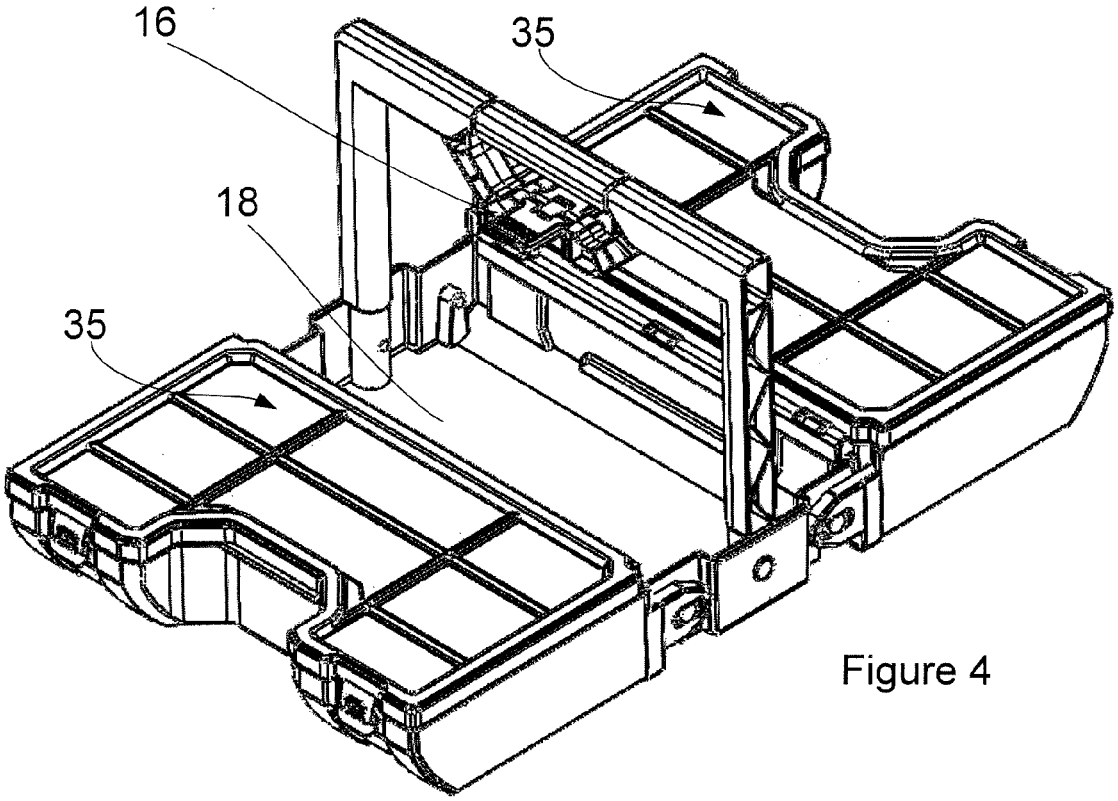
FIG. 4 is a perspective view showing both sides fully open.
Figure 5:
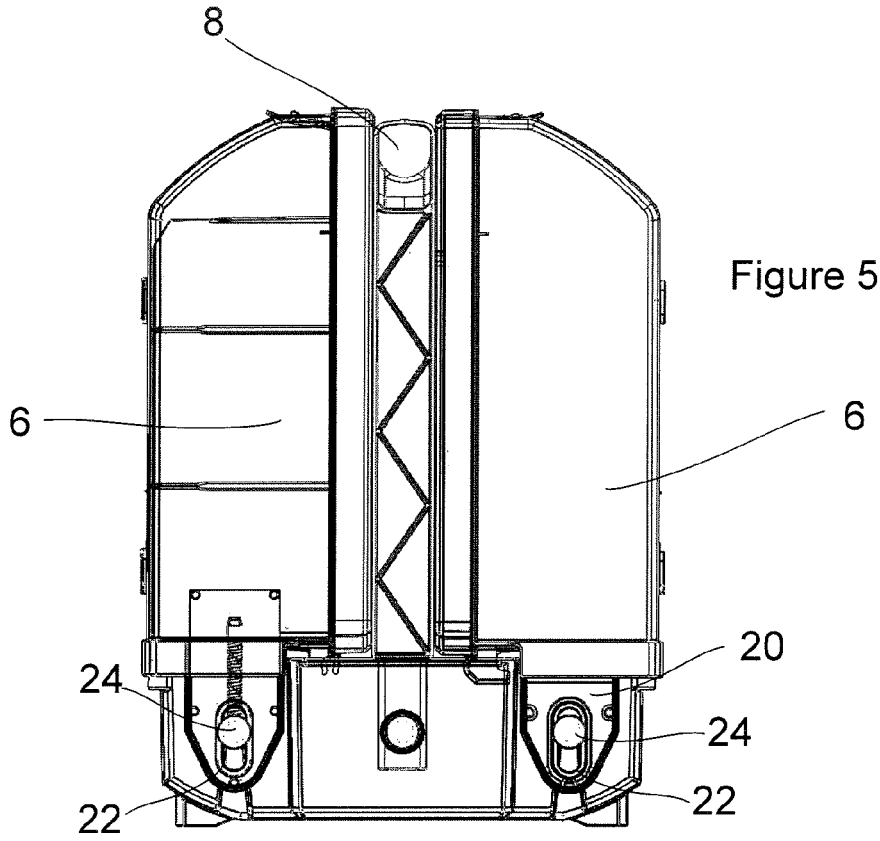
FIG. 5 is a side elevation showing both sides fully closed with a partial cut-away showing cam biasing means.
Figure 6:
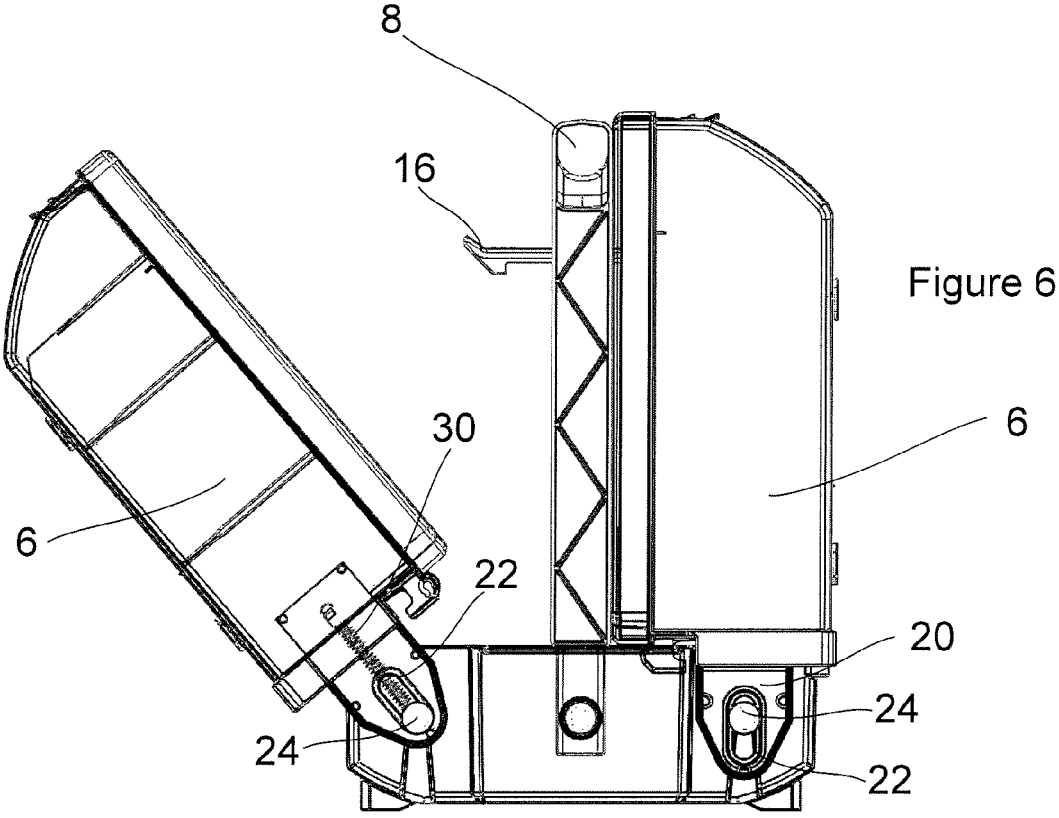
FIG. 6 is a side elevation showing one side partially opened with a partial cut-away showing cam biasing means.
Figure 7:
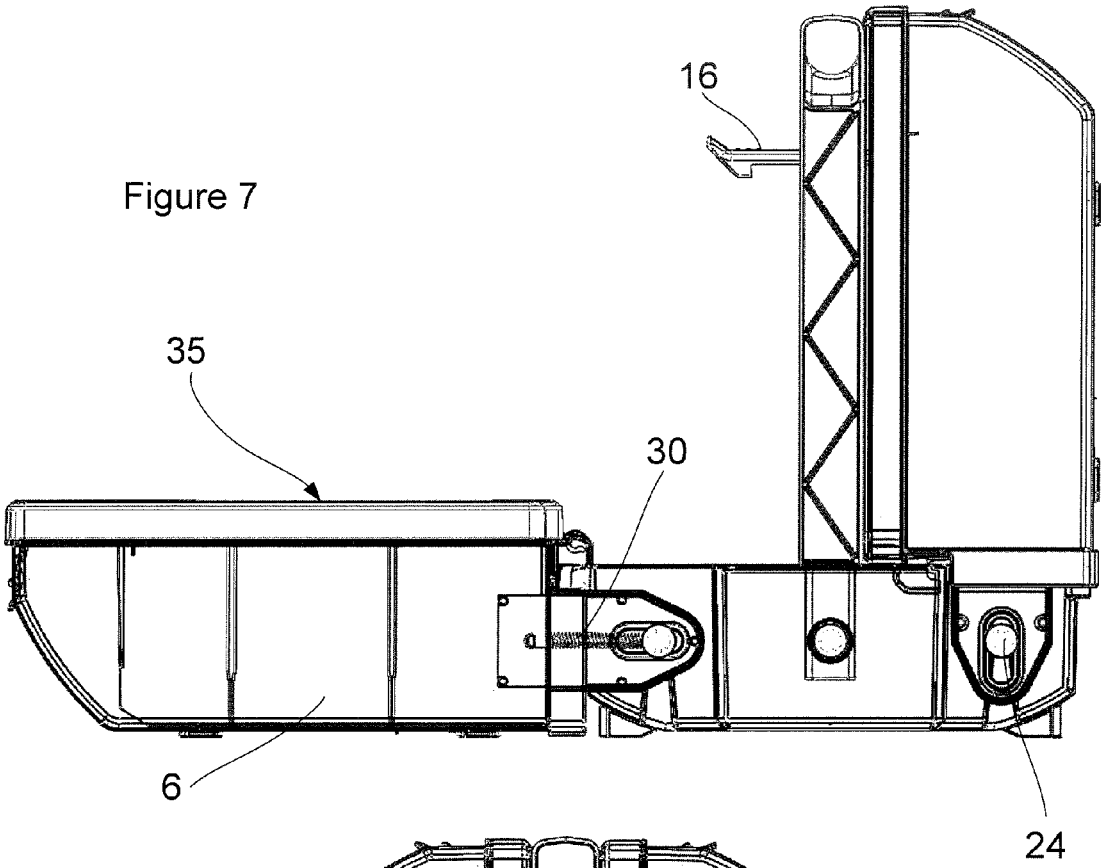
FIG. 7 is a side elevation showing one side fully opened with a partial cut-away showing cam biasing means.
Figure 8:
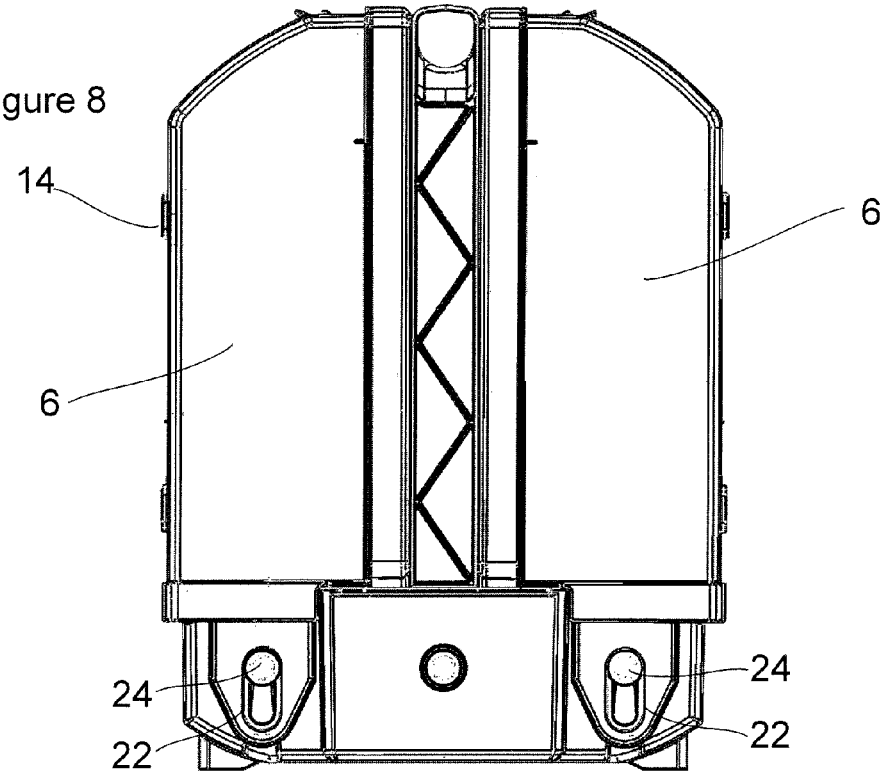
FIG. 8 is a side elevation of the toolbox fully closed.
Figure 9:
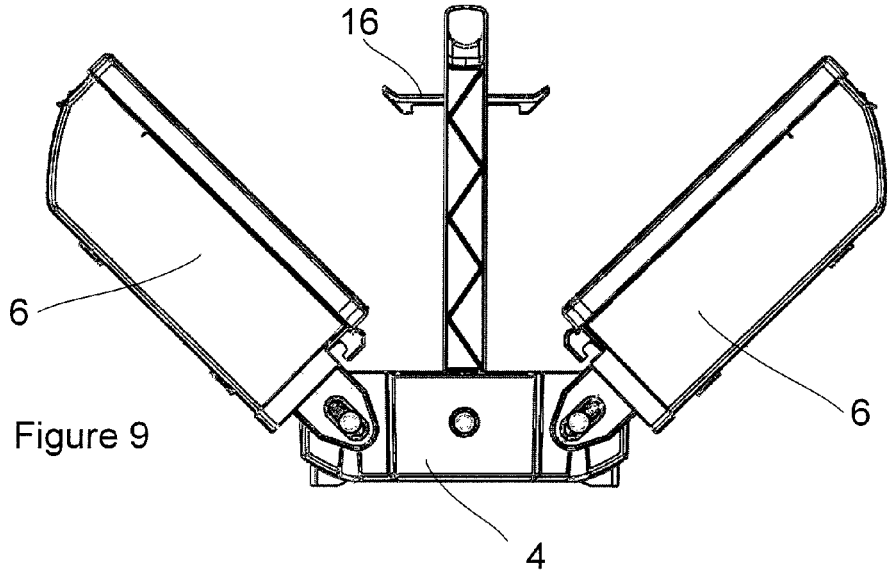
FIG. 9 is a side elevation of a toolbox showing both sides partially opened.
Figure 10:
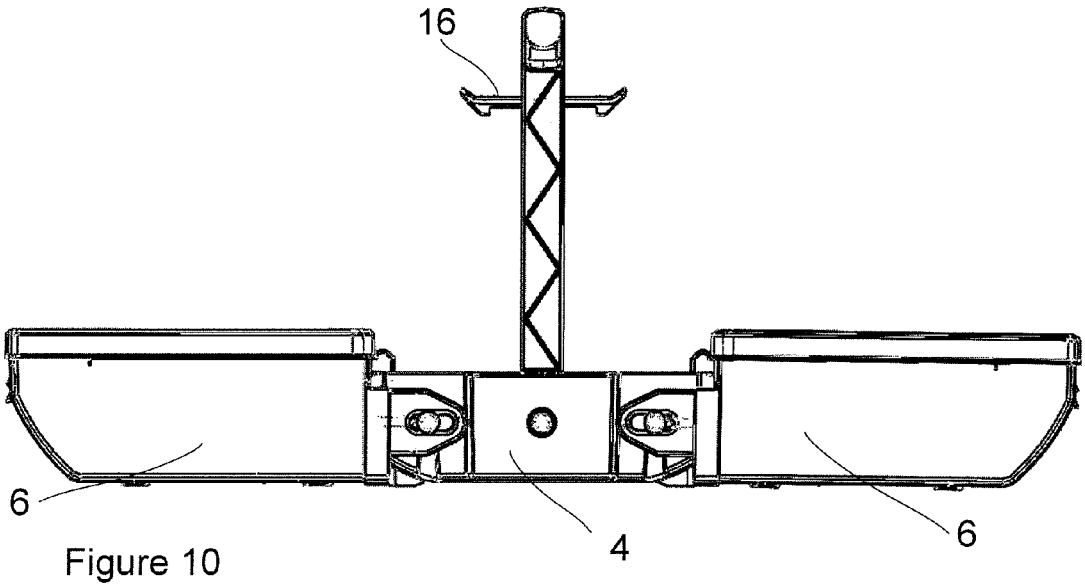
FIG. 10 is a side elevation of a toolbox showing both sides fully opened.

With particular reference to FIGS. 3 and 4 and also FIGS. 5 to 10, the central section 4 includes a relatively deep carrying tray 18 which may be used to store items such as bulky power tools.

Tray 18 is shown without dividers although it will be appreciated by the skilled person that dividers and/or drawers may be provided in these sections and similarly removable or permanently arranged drawers and dividers may be provided in the side sections 6. With reference also to FIGS. 5 to 10, the side sections 6 include tabs 20 extending from the edge opposite the latch 16, and which define elongate slots 22. The central section 4 carries hinge pins 24 engaged in respective slots 22 and thus allow the side sections 6 to hinge or pivot around the central section 4.

By engaging the pins 24 in slots 22, the side sections 6 are allowed to deviate from a strict arc about the hinge pins 22 as they pivot. This is because the slots allow the effective position of the pivot to be varied. This then allows considerable freedom in the design of the base tray 18 of a central section 4. For example, the depth of the tray 18 is then no longer constrained by the need to allow clear space for the side sections 6 to pivot. It will be appreciated by the skilled person that in the absence of freedom to move the pivot, a tall sided tray 18 would prevent the side sections 6 from folding outwardly.

Figure 11:
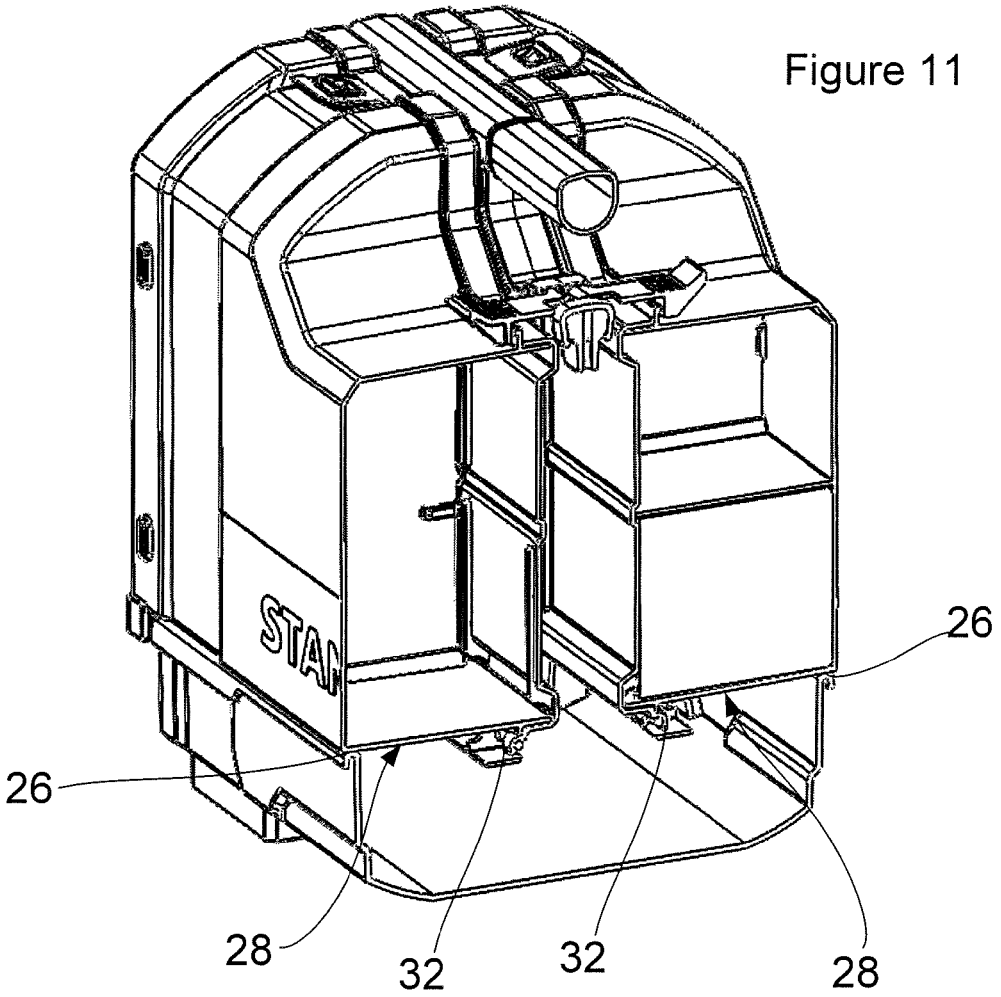
FIG. 11 is a perspective section showing a latch mechanism.
Figure 12:
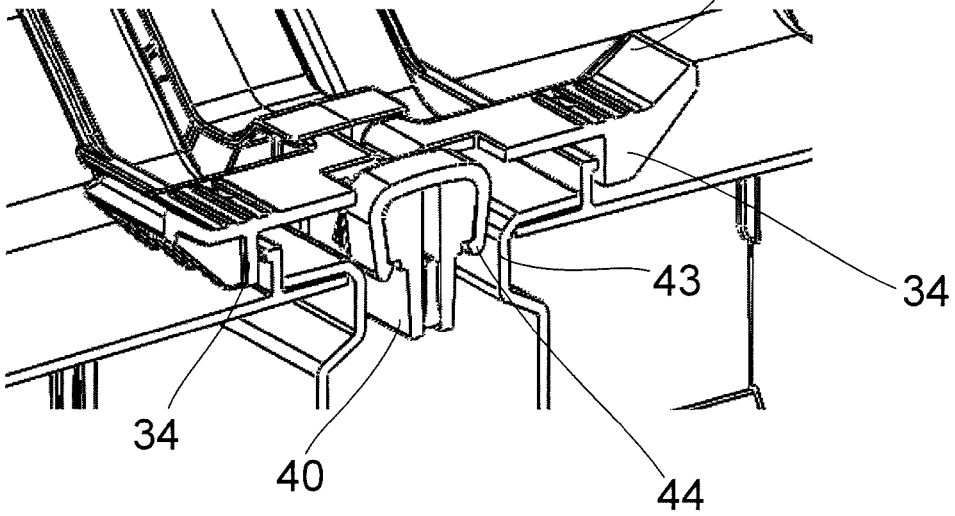
FIG. 12 is an enlargement of the latch mechanism of FIG. 12.
Figure 13:
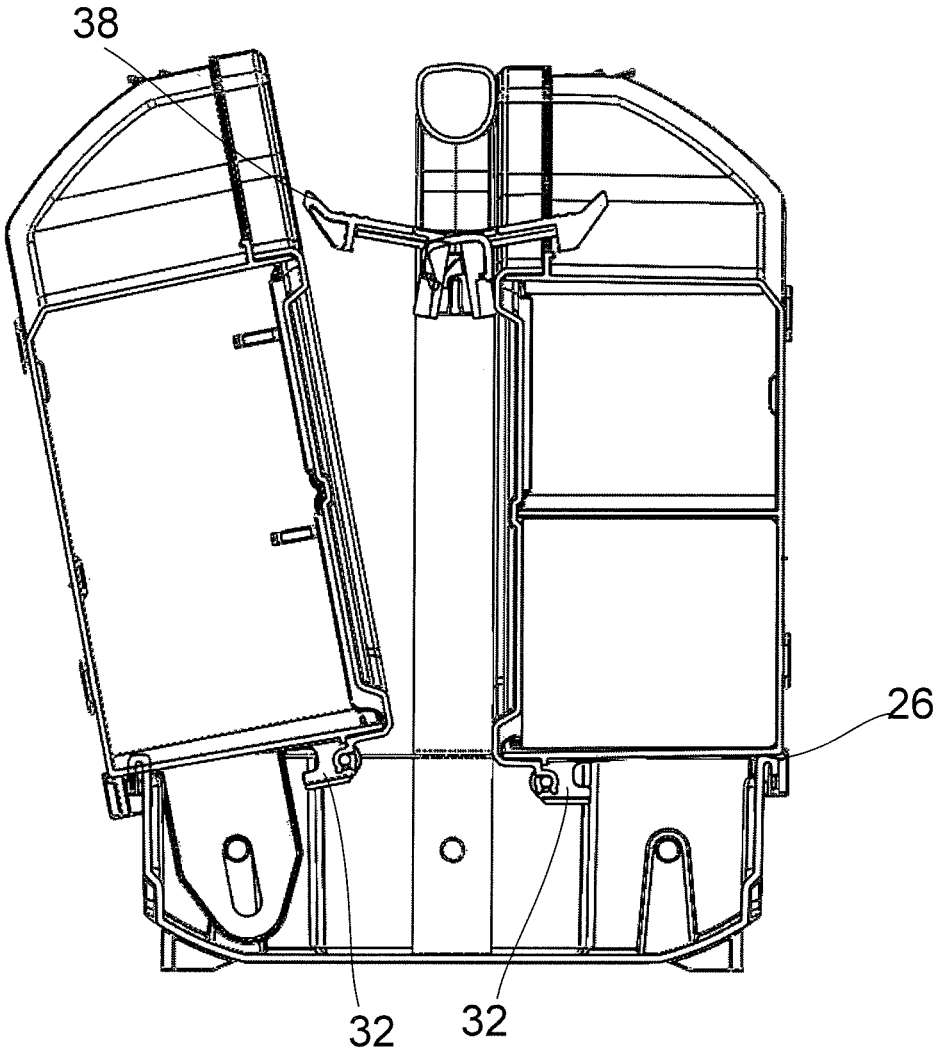
FIG. 13 is a section showing one side section partially open.

With reference to FIG. 11, the outer edge of the tray 18 is provided with a smooth lip 26 over which a lower surface 28 of the side sections rides as the side sections 6 are opened. This provides a cam and follower arrangement which controls the locus of the side sections as they are opened.

Preferably, biasing means such as a coil spring 30 (see FIGS. 5 to 7) are engaged between the central section 4 and the side sections 6 close to the pin and slot arrangement 22 and 24. This then causes the cam and follower 26 and 28 to remain in contact through the majority of the rotation of the side sections 6 around the inner section 4 during opening of the toolbox sides. Advantageously also, the position of the mounting points for the spring 30 may be arranged so that the spring 30 is at minimum extension when the side sections 6 are closed and optionally also when they are open. In this way as the side sections are opened the user will experience the need for additional opening force to be applied when the side sections are not in their open or closed position; thus providing a positive locking experience in the open or closed positions. Alternatively, the mounting points for the spring 30 may be arranged so that the spring 30 is slightly extended when the side sections 6 are closed and optionally also when they are open, in order to help retain the side section in the closed or open position. Also, with suitable choices of spring rates, it may be possible to allow the spring to assist in carrying the weight of the side section and its contents during the transition from open to closed and vice versa, by transmitting some of the weight through into the base of the central section 4 via the cam and follower 26 and 28, springs 30, slots 22 and hinge pins 24.

The cam surface 26 may also be arranged to engage a hook formation 32 when the side sections 6 are fully open. This then provides an end stop for the open position and, for example, allows the toolbox to be lifted using the handle 8 whilst maintaining the side sections in their approximately 90° open and extended positions.

Further advantageously, the side sections may have transparent lids 35 which allow a user to see the contents in the compartments in the side sections 6.

Figure 14:
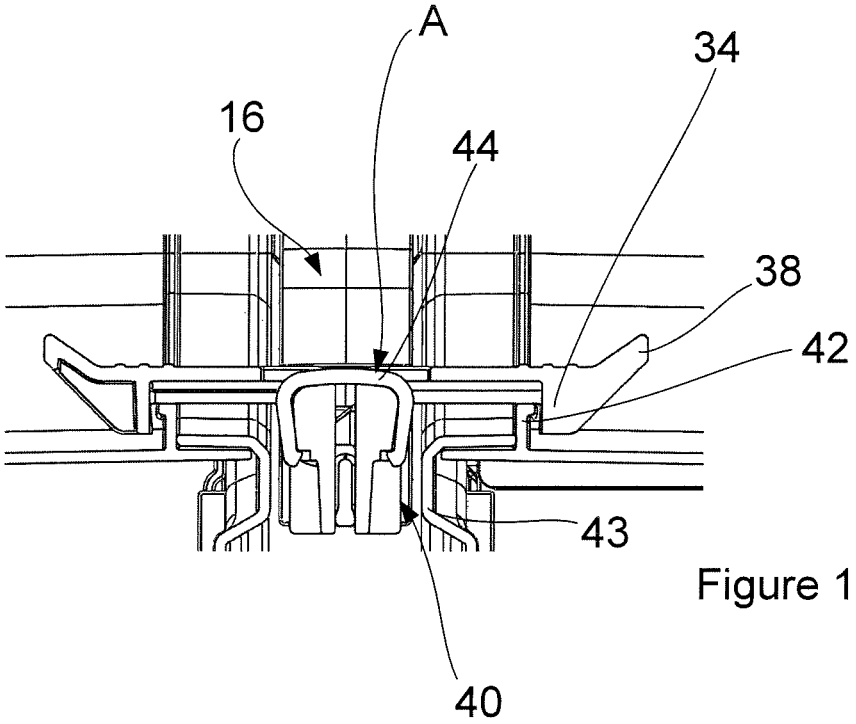
FIG. 14 is an enlargement of FIG. 14 showing closed latches.
Figure 15:
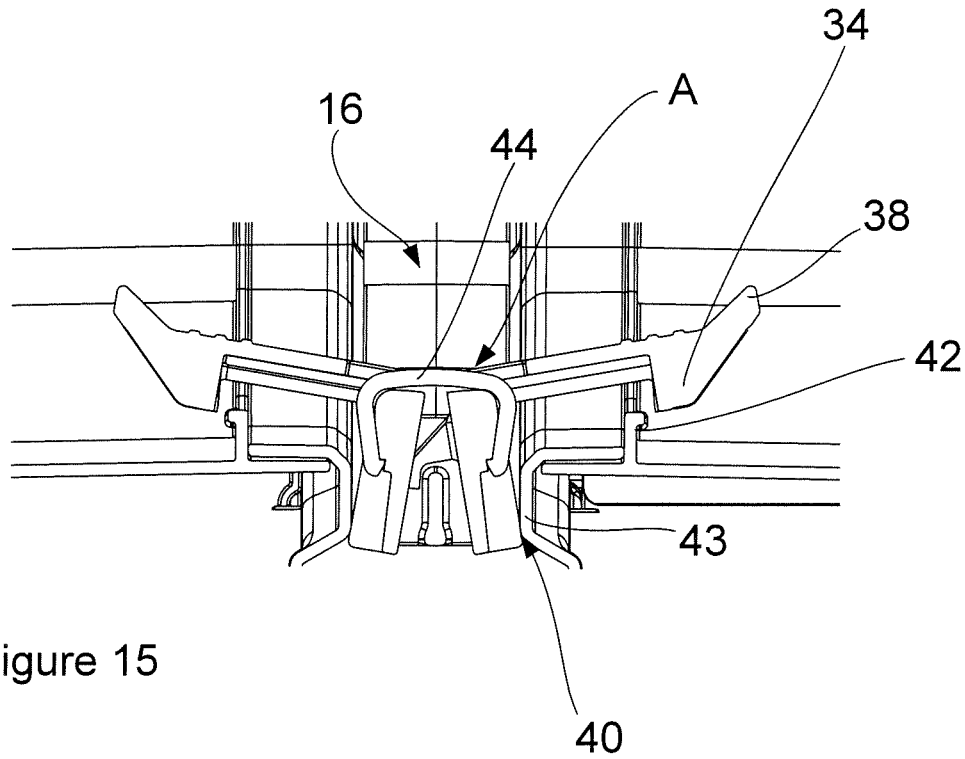
FIG. 15 is an enlargement of FIG. 14 showing open latches.

With reference to FIGS. 11 to 15, a pair of latches 16 are mounted on the central section 4. Each latch is generally "L" shaped as can be seen from FIGS. 13 to 15, and includes a hook 34, a finger pull 38 and a bearing surface 40. With reference to FIGS. 14 and 15, it will be seen that in the closed position, the hook 34 secures the side sections in their closed position by engaging with a locking finger 42. When a user lifts the finger pull 38, the hook 34 is brought out of engagement with the locking finger 42 and the side sections 6 are then free to pivot outwardly.

With particular reference to FIG. 15, it will be noted that the latch 16 pivots generally about a point A, at the corner of the L-shaped formation, and thus as the finger pull 38 is lifted, the bearing surface 40 presses against a ridge 43 formed in the side section 6. This thus presses the side section 6 outwardly so that the latch partially opens the section 6. In this way, a user is able to see that the section is open.

Optionally, a horseshoe spring 44 biases the latch towards its closed position which helps to hold the hook 34 engaged with the locking finger 42 when the sections 6 are in their closed positions.

For clarity, only one of the latches 16 has been labeled in the drawings. However, it will be appreciated that both latches are operable independently and in the same way and in this embodiment, are mirror images of each other. Also a plurality of latches 16 may be provided along the axis of the central section 4, which allows several latching points to be provided for a single side section 6 and/or allows a plurality of independently latched side sections 6 to be provided on one side of the central section 4.

We claim:

1. A toolbox comprising:

a first section for storage, and a second section for storage, the first section and the second section being pivotally attached together by a pivotal attachment;

wherein the pivotal attachment includes a pivot pin formed on the first section and engaged in an elongated slot or elongated groove formed in the second section;

wherein said elongated slot or elongated groove is elongated in a direction transverse to a pivot axis of the pivot pin such that the first section may pivot in an eccentric path around the second section;

a latch operable to secure the first and second sections together, the latch being pivotally mounted on one of the first section and the second section, having a hook arranged to engage the other of the first section and the second section when the latch is pivoted to a closed position, and having a lever arranged to push the first and second sections apart when the latch is pivoted to an open position;

wherein the latch comprises a generally L-shaped configuration, and is arranged to pivot generally around a corner of the generally L-shaped configuration;

wherein one arm of the generally L-shaped configuration carries the hook on an inside surface of the one arm, and another arm of the generally L-shaped configuration forms the lever.

2. The toolbox of claim 1, further comprising a cam surface formed on the first section, a cam follower surface formed on the second section and a cam bias member configured to bias the cam surface and cam follower surface together during travel through at least part of the eccentric path;

wherein the cam bias member, cam surface and cam follower are configured to generally constrain the pivot action to a predetermined eccentric path.

3. The toolbox of claim 2, wherein the cam bias member is configured to create a weaker biasing effect when the first and second sections are pivoted to the extremities of the eccentric path, creating a positive locking action at the extremities.

4. The toolbox of claim 1, wherein the first section comprises a carrying handle, and is configured to be substantially free standing on a horizontal surface.

5. The toolbox of claim 4, wherein the second section is configured to pivot through an arc of approximately 90 degrees so as to pivot between a closed position and an open position;

wherein in the open position, rest surfaces of the first section and the second section are aligned in substantially the same plane, such that the toolbox may rest upon the rest surfaces.

6. The toolbox of claim 1 further comprising a latch bias member arranged to bias the latch into the closed position.

7. The toolbox of claim 1, further comprising a plurality of second sections pivotally attached to the first section.

8. The toolbox of claim 7, wherein a pair of second sections are located on opposite sides of the first section.

9. A toolbox comprising:

a first section and a second section, the first section being pivotally attached to the second section; and a latch operable to secure the first and second sections together, the latch being pivotally mounted on one of the first section and the second section;

wherein the latch comprises a hook arranged to engage the other of the first section and the second section when the latch is pivoted to a closed position, and a lever arranged to push the first and second sections apart when the latch is pivoted to an open position;

wherein the latch comprises a generally L-shaped configuration and is arranged to pivot generally around a corner of the generally L-shaped configuration; and wherein one arm of the generally L-shaped configuration carries the hook on an inside surface of the one arm, and another arm of the generally L-shaped configuration forms the lever.

10. A toolbox comprising:

a first section and a second section, the first section being pivotally attached to the second section; and a latch operable to secure the first and second sections together, the latch being pivotally mounted on one of the first section and the second section; and a latch bias member arranged to bias the latch into the closed position;

wherein the latch comprises a hook arranged to engage the other of the first section and the second section when the latch is pivoted to a closed position, and a lever arranged to push the first and second sections apart when the latch is pivoted to an open position.

11. The toolbox of claim 10, wherein the first section is pivotally attached to the second section by a pivot pin formed on the first section and engaged in an elongated slot or elongated groove formed in the second section, said elongated slot or elongated groove being elongated in a direction transverse to a pivot axis of the pivot pin such that the first section may pivot in an eccentric path around the second section.

* * * * *